US005768874A

United States Patent [19]

Bourgois et al.

[11] Patent Number: 5,768,874

[45] Date of Patent: Jun. 23, 1998

[54] MULTI-STRAND STEEL CORD

[75] Inventors: Luc Bourgois, Desselgem; Paul Soenen, Kuurne; Frans Van Giel, Otegem, all of Belgium

[73] Assignee: N.V. Bekaert S.A., Zwevegem, Belgium

[21] Appl. No.: 727,035

[22] Filed: Oct. 8, 1996

[30] Foreign Application Priority Data

Oct. 27, 1995 [EP] European Pat. Off. ..... 95202911

[51] Int. Cl.[6] ..... D07B 1/06

[52] U.S. Cl. ..... 57/218; 57/902; 57/214

[58] Field of Search ..... 57/200, 214, 213, 57/218, 230, 231, 237, 236, 902, 12–15

[56] References Cited

U.S. PATENT DOCUMENTS

| | | | |
|---|---|---|---|
| 2,492,352 | 12/1949 | Bourdon | 57/214 X |
| 2,792,868 | 5/1957 | Benson | 57/902 X |
| 3,413,799 | 12/1968 | Lejeune | 57/218 X |
| 3,555,789 | 1/1971 | Terragna | 57/218 |

FOREIGN PATENT DOCUMENTS

| | | | |
|---|---|---|---|
| 0 373 595 | 6/1990 | European Pat. Off. . | |
| 837 683 | 2/1939 | France . | |
| 997 343 | 1/1952 | France . | |
| 592542 | 5/1959 | Italy | 57/214 |
| 621817 | 8/1978 | U.S.S.R. | 57/218 |
| 1 209 438 | 10/1970 | United Kingdom . | |
| 2268198 | 1/1994 | United Kingdom | 57/214 |

OTHER PUBLICATIONS

Emsworth, "Steel Cord Constructions Made in One Step", Research Disclosure, (1991), pp. 552–558.

*Primary Examiner*—Daniel P. Stodola
*Assistant Examiner*—Tina R. Taylor
*Attorney, Agent, or Firm*—Foley & Lardner

[57] ABSTRACT

A steel cord (10) comprises eight or more strands (12, 14) twisted together. Each of the strands has a substantially same cord twisting direction and a substantially same cord twisting pitch in the steel cord, and each of the strands consists of two to five individual filaments (16, 18) twisted together. Such a multi-strand steel cord can be manufactured without having to twist the individual strands separately and beforehand.

16 Claims, 3 Drawing Sheets

MULTI-STRAND STEEL CORD

FIELD OF THE INVENTION

The present invention relates to a steel cord comprising a number of strands twisted together, which is a so-called multi-strand steel cord.

BACKGROUND OF THE INVENTION

One to two decades ago, multi-strand steel cords were the standard cords for reinforcing elastomeric products such as rubber tires, conveyor belts, transmission belts.

A general trend towards simpler constructions comprising less filaments with larger filament diameters, however, has superseded the multi-strand steel cords except for those areas where multi-strand steel cords were really necessary because of their relatively thin filaments and the resulting high level of fatigue resistance or because of their high breaking load. Nowadays, multi-strand steel cords are still common in reinforcing heavy tires such as off-the-road tires, conveyor belts, timing belts and transmission belts.

Most multi-strand steel cords are manufactured in an expensive way the last steps of which may be summarized as follows:

(a) unwinding filaments, wet drawing the filaments until their final filament diameter and winding the thus drawn filaments;

(b) unwinding the drawn filaments, twisting the filaments into individual strands and winding the twisted strands;

(c) unwinding the strands, twisting the strands into a final cord and winding the twisted cord.

Especially step (b), which must be carried out for each individual strand of the final cord, e.g. seven times in case of a 7×19-cord, is disadvantageous to the productivity and efficiency of the multi-strand steel cord making process.

SUMMARY OF THE INVENTION

It is an object of the invention to provide for a new range of multi-strand steel cords that allows to skip the separate steps (b) of making the individual strands and which allows to replace the commonly used multi-strand steel cords such as 7×7-cord, 7×19-cord, 7×31-cord. According to the invention there is provided for a steel cord consisting essentially of eight or more strands twisted together. Each of the strands has a substantially same cord twisting direction and a substantially same cord twisting pitch. Each of said strands consists of two to five individual filaments twisted together. The terms "cord twisting pitch" refer to the axial distance required to make a 360° degree revolution of a strand in the final cord. As will be explained hereinafter, the fact that the strands have the same cord twisting direction and the same cord twisting pitch, allows the multi-strand steel cord to be made in an economical and highly efficient way. The fact that each of the strands consists of only two to five individual filaments and, as a consequence, comprises no core filament allows to make the multi-strand steel cord without experiencing problems of core filament migration in the individual strands. In a preferable embodiment of the invention, the individual steel filaments of every strand have the same strand twisting direction and substantially the same strand twisting pitch. The terms "strand twisting pitch" refer to the axial distance required to make a 360° degree revolution of a filament in a strand of the final cord. The number of strands in the multi-strand steel cord according to the invention is at least eight, and can be nine, twelve,fifteen . . . in order to provide for a suitable alternative for the prior art cord constructions 7×7 , 7×19, 7×31.

Preferable configurations, however, comprise twelve, nineteen or twenty-seven strands and are respectively designated by 12×n-, 19×n and 27×n-cords, where n is the number of filaments in each strand and ranges from two to five. A 12×n-cord has three center strands and nine outer strands. A 19×n-cord has one center strand, six intermediate strands and twelve outer strands.

A 27×n-cord has three center strands, nine intermediate strands and fifteen outer strands.

In order to prevent the center strand or center strands from migrating out of the cord under the influence of repeated external bending forces, it is preferable that the center strand or center strands have a larger diameter than the diameter of the outer strands and/or intermediate strands.

The strand twisting direction may be equal to or opposite to the cord twisting direction. As will be made clear hereinafter, a multi-strand steel cord where the strand twisting direction is equal to the cord twisting direction can be made in a highly efficient way.

The strand twisting pitch may be equal to or different from the cord twisting pitch.

The multi-strand steel cord is preferably adapted to reinforce elastomeric products, which means that it has either alone or in combination one or more of following properties:

the filament diameters range from 0.04 mm (e.g. for timing belt reinforcement) to 1.1 mm (e.g. for conveyor belts);

the steel composition generally comprises a minimum carbon content of 0.60%, a manganese content ranging from 0.20to 0.90% and a silicon content ranging from 0.10to 0.90%; the sulphur and phosphorous contents are preferably kept below 0.03%; additional elements such as chromium, boron, cobalt, nickel . . . may be added to the composition;

the filaments are conveniently covered with a corrosion resistant coating such as zinc or with a coating that promotes the adhesion to the elastomeric material such as brass or bronze.

Other applications of the multi-strand cord outside the field of elastomer reinforcement are not excluded. In this way the multi-strand cord according to the invention may have been covered with a synthetic material such as polyamide.

BRIEF DESCRIPTION OF THE DRAWINGS

The invention will now be described into more detail with reference to the accompanying drawings wherein.

DESCRIPTION OF THE PREFERRED EMBODIMENT OF THE INVENTION

Figure 1:
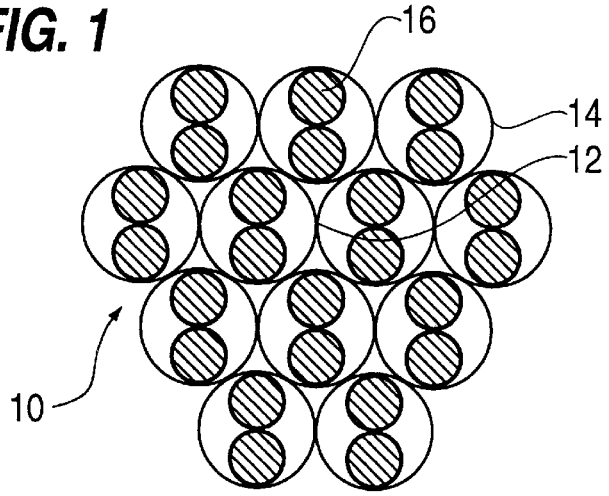
FIGS. 1, 2 and 3 show transversal cross-sections of 12×n-cords according to the present invention.

FIG. 1 shows a transversal cross-section of a 12×2 multi-strand steel cord 10. The cord 10 comprises three center strands 12 and nine outer strands 14. Each of the center strands 12 and each of the outer strands 14 consists of only two filaments 16. Each of the center 12 and each of the outer strands 14 have the same cord twisting pitch and same cord twisting direction in the final cord 10, for example:

12×2×0.20 cord twisting pitch=10 mm
cord twisting direction=Z
strand twisting pitch=10 mm
strand twisting direction=S
12×2×0.20 cord twisting pitch=10 mm
cord twisting direction=S
strand twisting pitch=10 mm
strand twisting direction=S.

Figure 2:
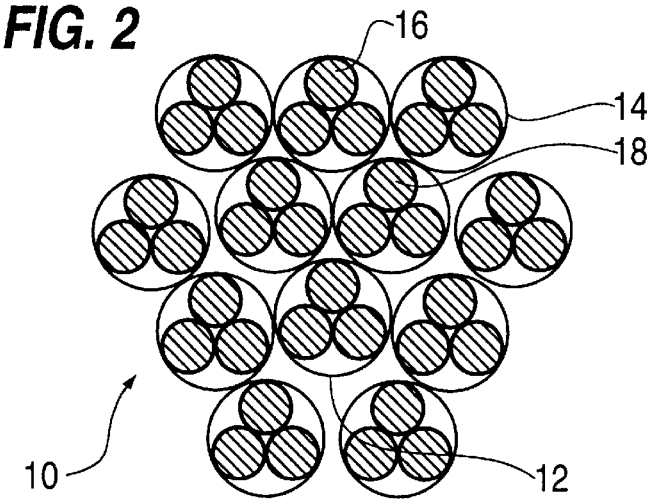

FIG. 2 shows a transversal cross-section of a 12×3 multi-strand steel cord. Steel cord 10 comprises three center strands 12 and nine outer strands 14. The diameter of the center strands 12 is somewhat larger than the diameter of the outer strands 14 because the filaments 18 of the center strands have a filament diameter that is larger than the filaments 16 of the outer strands.

An example is as follows:

3×3×0.175|9×3×0.15
cord twisting pitch and direction=8 Z
strand twisting pitch and direction=8 S.

Figure 3:
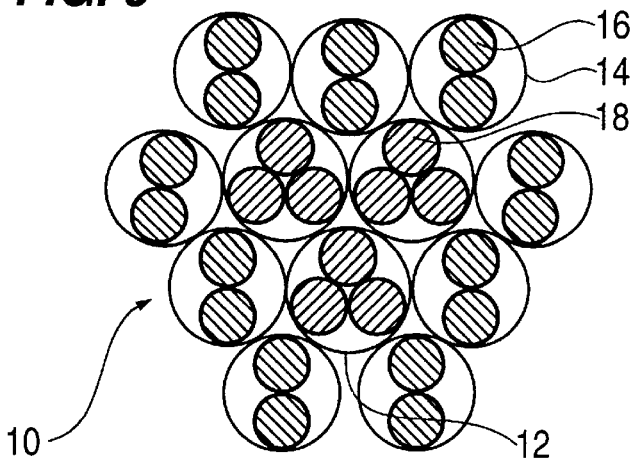

FIG. 3 shows a cross-section of another embodiment cord that comprises also three center strands 12 and nine outer strands 14. The center strands 18 have a diameter larger than the diameter of the outer strands 18 by the fact that they consist of three filaments 18 while the outer strands 14 consist only of two filaments 16. The filaments 18 of the center strands and the filaments 16 of the outer strands have an equal diameter.

An example is:

3×3×0.15|9×2×0.15
cord twisting pitch and direction=16 S
strand twisting pitch and direction=8 S.

Figure 4:
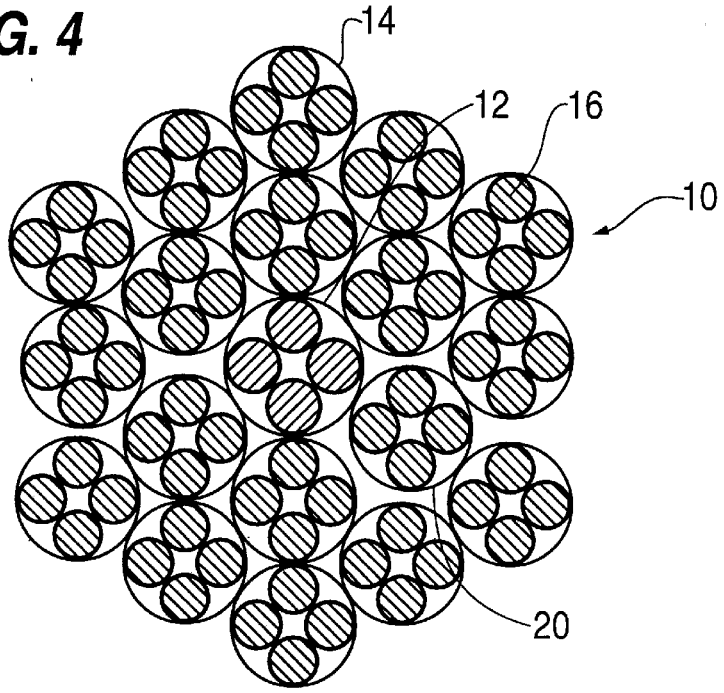
FIG. 4 shows a transversal cross-section of a 19×n-cord according to the present invention.

FIG. 4 shows a cross-section of a 19×4 multi-strand steel cord 10. The cord comprises one center strand 12, six intermediate strands 20 and twelve outer strands 14. Each of the strands consists of four filaments. The four filaments of the center strand 12, however, have a diameter that is somewhat larger than the diameter of the filaments of the intermediate strands 20 and outer strands 14.

Figure 5:
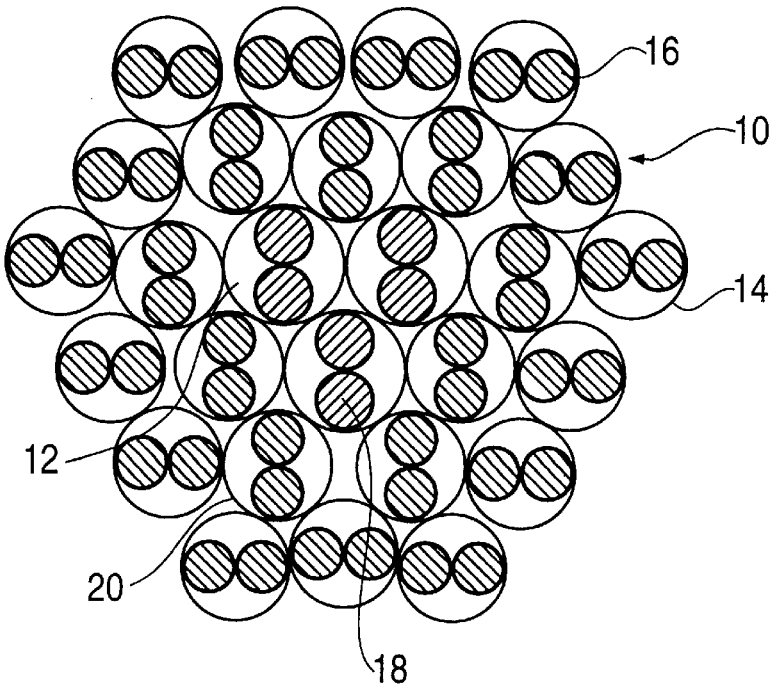
FIG. 5 shows a transversal cross-section of a 27×n-cord according to the present invention.

FIG. 5 shows a cross-section of a 27×2 multi-strand steel cord 10. The cord comprises three center strands 12, nine intermediate strands 20 and fifteen outer strands 14. Each of the strands consists of two filaments. The two filaments 18 of the center strand 12, however, have a diameter that is somewhat larger than the diameter of the filaments 16 of the intermediate strands 20 and outer strands 14.

The multi-strand steel cords according to the invention may be used to replace the common multi-strand steel cords without loss in breaking load or in other mechanical properties. Some examples:

a 7×7×d cord has 49 filaments and may be replaced by a $19\times2\times d_1$, cord (38 filaments) with $d_1$ greater than d or by a $19\times3\times d_2$ (57 filaments) with $d_2$ smaller than d;

a 19×7×d cord has 133 filaments and may be replaced by a 27×5×d cord (135 filaments).

Figure 6:
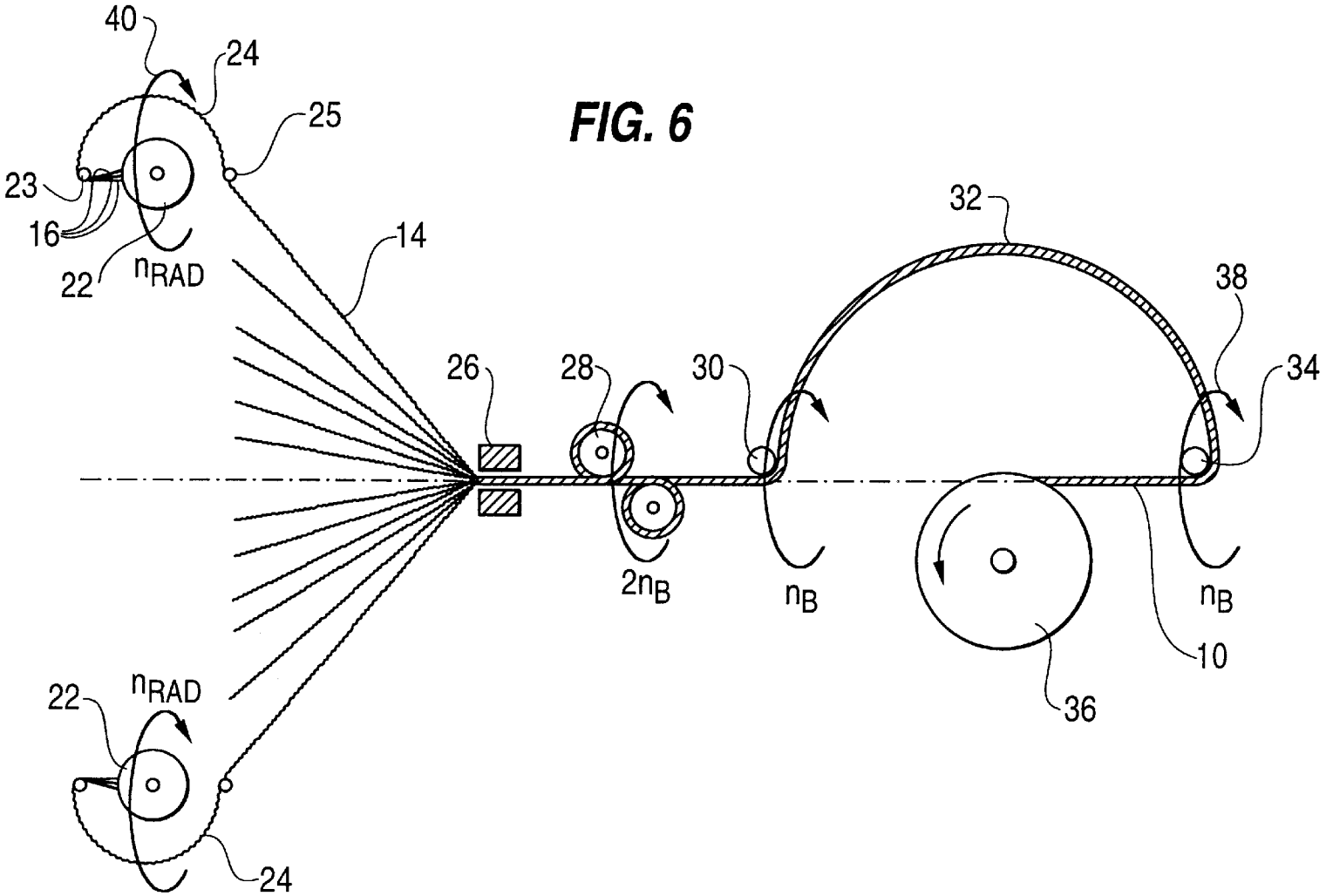
FIG. 6 shows schematically how a multi-strand cord according to the invention can be made.

FIG. 6 illustrates how a 12×3 multi-strand steel cord according to the invention can be made in one single cord making step, thus avoiding the multiple steps of making the individual strands.

Starting from the left side of FIG. 6, three individual filaments 16 are drawn from one supply spool 22 or from three separate supply spools 22. The filaments 16 are guided via a reversing pulley 23, over a flyer 24 to a guiding pulley 25. Flyer 24 rotates at a rotational speed nRAD and gives to the filaments 16 two twists per rotation so that a (provisional) strand 14 is made. This is done twelve times simultaneously. The whole set of twelve supply spools 22 and the corresponding flyers 24 form a so-called rotating pay-off installation. The twelve provisional strands are brought together at an assembly point 26 and are guided to a false twister 28, which rotates at twice the rotational speed nB of a downstream double-twister. The function of this false twister 28 is to draw the exact lengths of the strands they need in the final cord since at the level of false twister 28 the cord temporarily reaches its final cord twisting pitch. After leaving false twister 28, the assembled strands are led via a guiding pulley 30, over a flyer 32 and a reversing pulley 34 and are eventually wound on a spool 36. Flyer 32 rotates at a rotational speed $n_B$, gives two twists per rotation to the assembled strands and lays down the final cord twisting pitch of multi-strand cord 10 and also (together with rotating flyers 24) the final strand twisting pitch.

Suppose as a matter of a first example the following situation flyer 32 of the double-twister rotates at a rotational speed $n_B$ of 2000 rpm in the sense of arrow 38 as indicated in FIG. 6 (gives Z-twisting);

flyers 24 of the rotating pay-off installation rotate at a rotational speed $n_{RAD}$ of 4000 rpm ($=2\times n_B$) in the sense of arrow 40 (gives S-twisting).

This results in 12×3 multi-strand cord with following characteristics:

cord twisting pitch and direction=×mm S strand twisting pitch and direction=×mm Z, since half of the twists given to the strands by means of flyers 24 have been compensated by means of downstream flyer 32 in the final cord making step.

Suppose as a matter of a second example the following situation:

flyer 32 of the double-twister rotates at a rotational speed $n_B$ of 1000 rpm in the opposite sense of arrow 38 as indicated in FIG. 6 (gives S-twisting);

flyers 24 of the rotating pay-off installation rotate at a rotational speed $n_{RAD}$ of 1000 rpm ($=2\times n_B$) in the sense of arrow 40 (gives also S-twisting).

This results in 12×3 multi-strand cord with following characteristics:

cord twisting pitch and direction=2×mm S, since flyer 32 rotates at half the speed of flyer 32 in the first example;

strand twisting pitch and direction=×mm S, since the twists given by flyers 24 of the rotating pay-off installation and the twists given by flyer 32 of the double-twister are now added.

This second example illustrates an advantageous embodiment of the multi-strand cord according to the invention. If the cord twisting direction and the strand twisting direction are equal, the twists given by the flyers of the rotating pay-off installation are added to the twists given by the flyer of the double-twister so that the final twists are obtained with a minimum of twisting energy (compare the much higher rotational speeds of the first example with the rotational speeds of the second example!).

The rotational speed $n_{RAD}$ of the flyers of the rotating pay-off installation is in any way different from the rotational speed $n_B$ of the flyer of the double-twister in order to avoid a situation where the twists given by the flyers of the rotating pay-off installation would be hundred per cent compensated by the twists given by the flyer of the double-twister, which would result in steel cords where the difference between the strands would disappear and result in so-called compact steel cords consisting only of filaments having the same cord twisting pitch and cord twisting direction which are equal to the strand twisting pitch and strand twisting direction.

We claim:

1. A steel cord comprising at least eight strands twisted together, all strands of said steel cord having a same twisting direction called cord twisting direction and a substantially same twisting pitch called cord twisting pitch, each of said strands consisting of two to five individual filaments twisted together.

2. A steel cord according to claim 1, wherein the individual filaments of each of said strands are twisted in a same twisting direction called strand twisting direction and with a same twisting pitch called strand twisting pitch.

3. A steel cord according to claim 2, wherein said cord twisting direction is equal to said strand twisting direction.

4. A steel cord according to claim 2, wherein said cord twisting direction is opposite to said strand twisting direction.

5. A steel cord according to claim 2, wherein said cord twisting pitch is substantially equal to said strand twisting pitch.

6. A steel cord according to claim 2, wherein said cord twisting pitch is different from said strand twisting pitch.

7. A steel cord according to claim 1, wherein the number of strands is twelve, with three center strands and nine outer strands.

8. A steel cord according to claim 7, wherein all of said outer strands have a substantially same outer strand diameter and at least one of said center strands has a strand diameter greater than the strand diameter of the outer strands.

9. A steel cord according to claim 8, wherein all of said outer strands have filaments with a substantially same filament diameter, said at least one center strand comprising filaments having a diameter larger than the filament diameter of the filaments of the outer strands.

10. A steel cord according to claim 8, wherein all of said outer strands have a same number of filaments, said at least one center strand having more filaments than said outer strands.

11. A steel cord according to claim 1, wherein the number of strands is nineteen, with one center strand, six intermediate strands, and twelve outer strands.

12. A steel cord according to claim 11, wherein all of said intermediate strands have a substantially same diameter and all of said outer strands have a substantially same diameter, the center strand having a diameter larger than the diameter of the intermediate strands and larger than the diameter of the outer strands.

13. A steel cord according to claim 1, wherein the number of strands in the steel cord is twenty-seven, with three center strands, nine intermediate strands, and fifteen outer strands.

14. A steel cord according to claim 13, wherein all of said intermediate strands have a substantially same diameter and all of said outer strands have a substantially same diameter, at least one of said center strand having a diameter larger than the diameter of the intermediate strands and larger than the diameter of the outer strands.

15. A steel cord according to claim 1, wherein the individual filaments of some of said strands are twisted in a strand twisting direction different from the strand twisting direction of the individual filaments of the other strands.

16. A steel cord according to claim 1, wherein the individual filaments of some of said strands are twisted with a strand twisting pitch different from the strand twisting pitch of the individual filaments of the other strands.

* * * * *